United States Patent [19]

Tabata et al.

[11] Patent Number: 4,907,370

[45] Date of Patent: Mar. 13, 1990

[54] GRINDING STONE DRESSING DEVICE

[75] Inventors: Yutaka Tabata; Toshio Nishikawa, both of Mie; Hiroshi Sakai, Matsusaka, all of Japan

[73] Assignee: Central Glass Company, Limited, Ube, Japan

[21] Appl. No.: 241,251

[22] Filed: Sep. 7, 1988

[30] Foreign Application Priority Data

Mar. 22, 1988 [JP] Japan ..... 63-36435[U]

[51] Int. Cl.[4] ..... B24B 53/12

[52] U.S. Cl. ..... 51/5 D; 51/262 T; 51/262 A; 51/83 E; 125/11 R

[58] Field of Search ..... 51/5 D, 262 T, 262 A, 51/283 E, 325; 125/11 R, 11 CW, 11 H

[56] References Cited

U.S. PATENT DOCUMENTS

| | | | |
|---|---|---|---|
| 1,651,225 | 11/1927 | Owen | 125/11 R X |
| 2,337,183 | 12/1943 | Canning . | |
| 2,515,091 | 7/1950 | May . | |
| 3,141,452 | 7/1964 | Kopec | 125/11 R |
| 3,372,687 | 3/1968 | Grabowski | 125/11 R |
| 3,517,659 | 6/1970 | Stewart et al. | 125/11 R |
| 3,553,893 | 1/1971 | Stade | 51/5 D |
| 4,094,101 | 6/1978 | Robinson | 51/5 D |

FOREIGN PATENT DOCUMENTS

| | | | |
|---|---|---|---|
| 0062318 | 10/1982 | European Pat. Off. . | |
| 2349871 | 4/1975 | Fed. Rep. of Germany | 51/283 E |
| 3233609 | 3/1984 | Fed. Rep. of Germany . | |
| 3321070 | 12/1984 | Fed. Rep. of Germany . | |
| 114890 | 9/1979 | Japan | 51/5 D |
| 56-6282 | 2/1981 | Japan . | |

*Primary Examiner*—Robert P. Olszewski

*Attorney, Agent, or Firm*—Fleit, Jacobson, Cohn, Price, Holman & Stern

[57] ABSTRACT

A dressing device for dressing a grinding stone is disclosed. The grinding stone is used for grinding an edge of a glass pane. The dressing device comprises a container in which dressing members are contained and piled. A grooved holding member mounts thereon the container. The holding member includes a front portion projected forward from a front wall of the container and a rear portion projected rearward from a rear wall of the container. The front and rear walls of the container are respectively formed with front and rear openings whose lower peripheries are bounded by a bottom wall of the groove of the grooved holding member. The front opening is so sized to pass therethrough each of the dressing members. A pushing plate is slidably received in the groove of the rear portion of the holding member. The pushing plate is so sized so as to pass through the rear opening. The hydraulically oprated cylinder moves reciprocatively the pushing plate in the along the groove between a position wherein a forward end of the pushing plate is deeply inserted into the container through the rear opening and another position wherein the forward end is drawn away from the container.

10 Claims, 2 Drawing Sheets

GRINDING STONE DRESSING DEVICE

BACKGROUND OF THE INVENTION

1. Field of the Invention

The present invention relates to a dressing device for dressing a grinding stone, and more particularly to a dressing device for dressing a circular grinding stone which is used for grinding an edge of a glass pane.

2. Description of the Prior Art

In window panes used in an automotive field, it is usual to chamfer the edge of the window pane (viz., glass pane) for safety of persons who handle the same. In order to provide a glass pane with a chamferred edge, a circular grinding stone with a grooved rim has been used. The inner surface of the groove is coated with a mixture of diamond powder and metal powder to provide a concave grinding surface. In operation, the grinding stone is rotated about its axis and brought to a work position where the concave grinding surface thereof is in contact with the edge of the glass pane which is to be chamferred. With this, the edge of the glass pane is grinded and thus chamferred. One of the grinding stones of the above-mentioned type is disclosed in Japanese Utility Model Second Provisional Publication No. 56-6282. In the grinding stone of this publication, a plurality of vacant holes are formed in and around the concave grinding surface for the purpose of prolonging the life of the grinding stone.

However, after long use of the grinding stone, the grinding surface of the same suffers from a blinding or wearing and thus the grinding performance of the same is lowered. Under this condition, it is necessary to dress the worn grinding surface for having a fresh grinding surface exposed.

Hitherto, the dressing of the grinding stone has been made by dismantling the worn grinding stone from a rotation shaft of a grinding device on which the same has been rotatably mounted, then applying the grinding stone to a separate dressing device and thereafter mantling the grinding stone now dressed to the rotation shaft of the grinding device.

However, this dressing step has inevitably such drawbacks that the work for dismantling and mantling the grinding stone from and to the rotation shaft is very troublesome and repeated dismantling and mantling work causes lowering in assembling accuracy of the same relative to the rotation shaft.

SUMMARY OF THE INVENTION

It is therefore an object of the present invention to provide a grinding stone dressing device which is free of the above-mentioned drawbacks.

According to the present invention, there is provided a dressing device by which the dressing of a worn grinding stone is carried out with the grinding stone kept on the rotation shaft of the dressing device.

According to the present invention, there is provided a dressing device which can automatically feed a new dressing member when an older dressing member has worn out.

According to the present invention, there is provided an improved dressing device for dressing a grinding stone which grinds an edge of a glass pane. The dressing device comprises a container in which dressing members are contained and piled; a grooved holding member on which the container is mounted, the holding member including a front portion projected forward from a front wall of the container and a rear portion projected rearward from a rear wall of the container; means defining in the front and rear walls of the container front and rear openings whose lower peripheries are bounded by a bottom wall of the groove of the grooved holding member, the front opening being so sized as to pass therethrough each of the dressing members; a pushing plate slidably received in the groove of the rear portion of the holding member, the pushing plate being so sized as to pass through the rear opening; and means for reciprocatively moving the pushing plate in and along the groove between a position wherein a forward end of the pushing plate is deeply inserted into the container through the rear opening and another position wherein the forward end is drawn away from the container.

BRIEF DESCRIPTION OF THE DRAWINGS

Other objects and advantages of the present invention will become, apparent from the following description when taken in conjunction with the accompanying, drawings, in which.

DETAILED DESCRIPTION OF THE INVENTION

Figure 1:
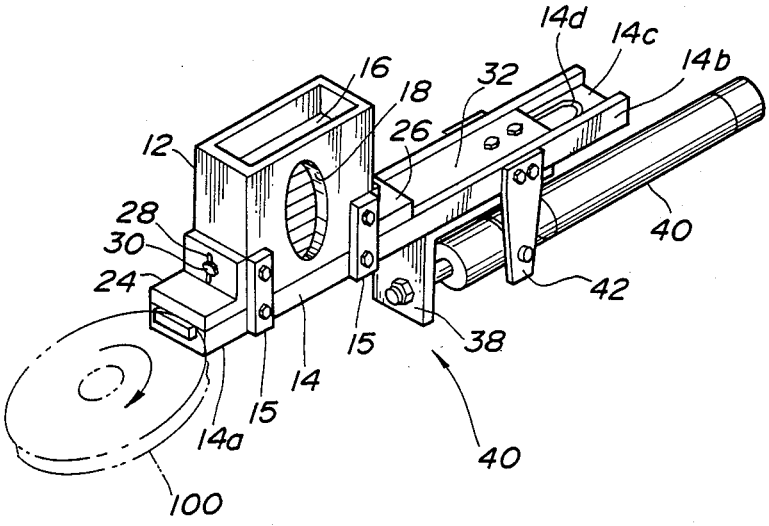
FIG. 1 is, a perspective view of a dressing device according to the present invention.

Referring to the drawings, particularly FIG. 1, there is shown a dressing device according to the present invention, which is generally designated by numeral 10.

The dressing device 10 comprises a rectangular container 12 whose bottom is defined by a grooved holding member 14 secured thereto through connecting brackets 15. Within the container 12, there are contained a plurality of rectangular dressing members 16 being piled up. The container 12 has at one wall thereof a window 18 through which the interior (viz, the piled dressing members 16) of the container 12 is viewed from the outside.

Figure 2:
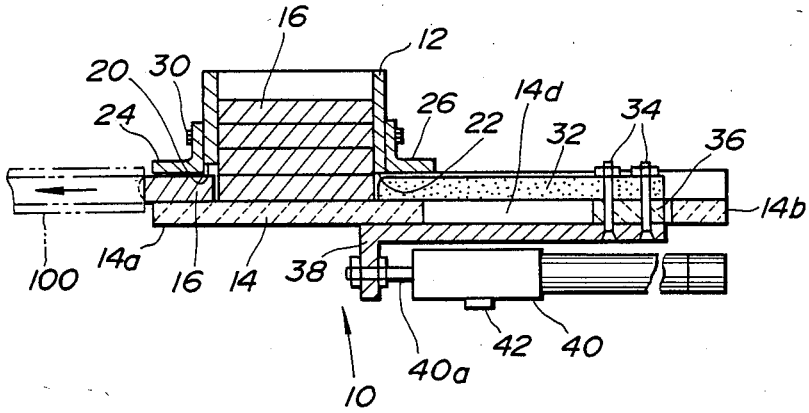
FIG. 2 is a sectional view of the dressing device of the present invention.

As is seen from FIG. 2, the container 12 is formed at its front and rear lower wall portions with rectangular openings 20 and 22 whose lower ends are bounded by a bottom wall of the groove of the holding member 14. The front opening 20 is so sized as to pass therethrough the dressing member 16, while, the rear opening 22 is so sized as to pass therethrough an after-described pushing plate 32. The groove **14*c* of the holding plate is so sized as to match with the dressing member 16, so that the latter can slide smoothly in and along the groove 14*c***.

As is best seen from FIG. 1, the grooved holding member 14 has a front extension **14*a* which extends forward but slightly from the front wall of the container 12 and a rear extension 14*b* which extends rearward by a considerable degree from the rear wall of the container 12**.

To the front and rear walls of the container 12, there are connected front and rear lid members 24 and 26 each having a generally L-shaped cross section, as shown. The front lid member 24 is adjustably connected to the front wall so that the size of front opening 20 is changeable in accordance with the thickness which the dressing members 16 to be used have. For achieving this adjustment, a so-called position adjuster is employed, which comprises a slit 28 formed in the front lid member 24 and a screw bolt 30 passing through the slit 28 and screwed into the front wall of the container 12. Upon the front lid member 24 taking a desired position, the screw bolt 30 is fastened for unmovably connecting the front lid member 24 to the front wall. While, the rear lid member 26 is unmovably bolted to the rear wall of the container 12.

As is shown in FIGS. 1 and 2, the rearward extension **14*b* of the grooved holding member 14 is formed at the bottom wall thereof with an axially extending guide slot 14*d***.

A rectangular pushing plate 32 is slidably received in the groove **14*c* of the rearward extension 14*b* of the grooved holding member 14. As is understood from FIG. 2, the pushing plate 32 has a thickness smaller than the height of the rear opening 22 of the container 12. With this, the pushing plate 32 is insertable into the container 12 through the rear opening 22. The rear end of the pushing plate 32 is connected through bolts and nuts 34 to a guide plate 36 which is slidably received in the guide slot 14*d*and to a rear end of a connecting plate 38 which is positioned at a lower side of the grooved holding member 14. Thus, it will be appreciated that the pushing plate 32, the guide plate 36 and the connecting plate 38** move together like a one piece unit.

The connecting plate 38 has a downwardly bent front portion to which a working stem **40*a* of a hydraulically operated cylinder 40 is connected. The cylinder 40 is tightly held by the grooved holding member 14 by means of brackets 42 and bolts and nuts, as is seen from FIG. 1. It is to be noted that a circular member illustrated by a phantom line and designated by numeral 100 in FIGS. 1 and 2** is a circular grinding stone which assumes a position to be dressed.

Figure 3:
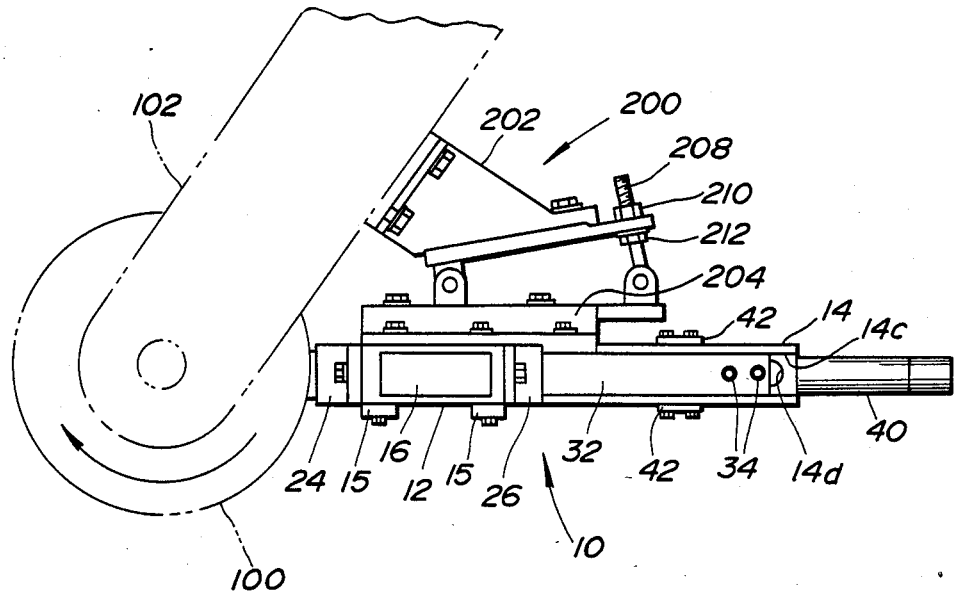
FIG. 3 is a plan view of the dressing device with a part of a grinding device to which the dressing device is mounted.

Referring to FIG. 3, there is shown the manner in which the dressing device 10 of the present invention is adjustably mounted to a window glass grinding device. The grinding device has a pivotal arm 102 on which the circular grinding stone 100 is rotatably mounted. Although not shown, a drive mechanism is installed in the pivotal arm 102 for rotation of the grinding stone 100.

For mounting the dressing device 10 to the pivotal arm 102, there is employed a pivot support 200 which comprises a base plate 202 which is bolted to the pivotal arm 102 and a pivoting arm 204 which is pivotally connected through a pivot pin 206 to the base plate 202 and bolted to the grooved holding member 14. With this, the entire of the dressing device 100 is pivotal relative to the pivotal arm 102. A threaded bolt 208 is pivotally connected to a free end of the pivoting arm 204, which passes through an aperture (no numeral) formed in the base plate 202. Two nuts 210 and 212 are engaged with the bolt 208 having the apertured portion of the base plate 202 put therebetween. Thus, the angle defined between the dressing device 10 and the wheel arm 102 is changeable by turning the nuts 210 and 212 about the bolt 208. That is, the positional relation between them can be adjusted by manipulating the nuts 210 and 212.

Operation of the dressing device 10 according to the present invention will be described in the following.

For ease of understanding, the description of operation will be commenced with respect to a condition wherein, as is shown in FIG. 3, the dressing device 10 assumes its work position with respect to the circular grinding stone 100 which is to be dressed. Under this condition, the frontmost end of the grooved holding member 14 is placed in the vicinity of the periphery of the circular grinding stone 100, the lowermost one of the piled dressing members 16 in the container 12 is neatly received in the groove **14*c* of the holding member 14, and the circular grinding stone 100** is rotating.

When the hydraulic cylinder 40 is energized, the working stem **40*a* of the same is gradually drawn out from the cylinder 40 thereby bringing the pushing plate 32 into contact with the rear end of the lowermost dressing member 16 in the container 12 and thus pushing the dressing member 16 out of the container 12 through the front opening 20. Thus, finally, the leading end of the dressing member 16 is brought into a frictional contact with the worn concave grinding surface of the grinding stone 100. Thus, thereafter, the dressing of the grinding stone 100 is carried out. During the dressing operation, the dressing member 16 is constantly biased by a given force toward the grinding stone 100 by the hydraulic cylinder 40**.

The dressing member 16 is gradually worn and thus gradually shifted toward the grinding stone 100, as will be seen from FIG. 2. When the dressing member 16 is worn to a certain degree, that is, when the rear end of the dressing member 16 comes to a predetermined position near the leading end of the holding member 14, a sensor (not shown) functions to reverse the movement of the working stem **40*a* of the hydraulic cylinder 40. When thus the pushing plate 32 is moved back to its rearmost rest position, a subsequent dressing member 16 falls into the groove 14*c* of the holding member 14 in the container 12** and thus assumes its "stand by" position.

Upon completion of the dressing, the pivotal arm 102 is turned to its work position where the refreshed grinding stone 100 is operatively applied to an edge of a glass pane which is to be chamferred.

When, thereafter, the wearing of the grinding stone 100 comes to a given degree, the pivotal arm 102 is moved away from the work position and then, the above-mentioned dressing operation starts again. During initial stage of this dressing operation, the prior dressing member 16 remained in the leading end of the holding member 14 is subjected to the dressing work. When the prior dressing member 16 is worn off, the subsequent dressing member 16 is brought into a frictional contact with the grinding stone 100 automatically, as will be understood from FIG. 2.

When, as has been mentioned hereinafore, the dressing members 16 to be used have different thicknesses, the size of the front opening 20 of the container 12 is changed by moving the front lid member 24 upward or downward with the screw bolt 30 loosened.

Because the dressing member 16 in its work position is stably held in an enclosed space which is defined by the grooved holding member 14 and the front lid member 24, the entire of it can be used for the dressing.

The rear lid member 26 can promote the sliding movement of the pushing plate 32 in and along the groove **14*c* of the holding member 14**.

Due to provision of the window 18 in the container 12, the number of the dressing members 16 remained in the container 16 is easily checked.

Although the dressing device 10 of the present invention has been described to be mounted to the window glass grinding device, the dressing device 10 may be mounted to another device so long as the same can be operatively engaged with the circular grinding stone 10 when the pivotal arm 102 is moved away from its work position.

WHAT IS CLAIMED IS:

1. A dressing device for dressing a grinding stone which grinds an edge of a glass pane, comprising:

a container in which dressing members are contained and piled;

a grooved holding member on which said container is mounted, said holding member including a front portion projected forward from a front wall of said container and a rear portion projected rearward from a rear wall of said container;

means defining in said front and rear walls of said container front and rear openings whose lower peripheries are bounded by a bottom wall of the groove of said grooved holding member, said front opening being so sized as to pass therethrough each of said dressing members;

a pushing plate slidably received in the groove of said rear portion of said holding member, said pushing plate being so sized as to pass through said rear opening; and means for reciprocatively moving said pushing plate in and along said groove between a position wherein a forward end of said pushing plate is deeply inserted into said container through said rear opening and another position wherein said forward end is drawn away from said container.

2. A dressing device as claimed in claim 1, further comprising a front lid member which is connected through a position adjusting means to said front wall of said container in a manner to adjust the size of said front opening.

3. A dressing device as claimed in claim 2, in which said position adjusting means comprises:

a lid member having a generally L-shaped cross section, said lid member having at one part thereof a slot formed therethrough; and a screw bolt passing through said slot and screwed into said front wall of said container.

4. A dressing device as claimed in claim 3, in which the other part of said lid member covers the groove of said front portion of said grooved holding member.

5. A dressing device as claimed in claim 4, further comprising a rear lid member which is connected to said rear wall of said container in a manner to rim said rear opening of said container.

6. A dressing device as claimed in claim 1, in which said means comprises:

a hydraulically operated cylinder connected to said grooved holding member; and movement transmitting means for transmitting a movement of a work stem of said cylinder to said pushing plate.

7. A dressing device as claimed in claim 6, in which said movement transmitting means comprises:

means defining in a bottom wall of said rear portion of said grooved holding member an elongate guide slot;

a guide plate slidably received in said elongate guide slot;

a connecting plate having one end connected to said work stem of said cylinder; and bolts and nuts which connect said pushing plate, said guide plate and said connecting plate.

8. A dressing device as claimed in claim 7, further comprising brackets through which said cylinder is secured to said grooved holding member.

9. A dressing device for dressing a grinding stone which grinds an edge of a glass pane, said dressing device comprising:

a plurality of rectangular dressing members;

a container having a rectangular cross section, said container containing therein said dressing members which are piled;

a grooved holding member on which said container is mounted, said holding member including a front portion projected forward from a front wall of said container and a rear portion projected rearward from a rear wall of said container;

means defining in said front and rear walls of said container front and rear rectangular openings whose lower peripheries are bounded by a bottom wall of the groove of said grooved holding member, said front opening being so sized as to pass therethrough each of said dressing members;

a front lid member connected to said front wall of said container in a manner to adjust the size of said front rectangular opening;

a pushing plate slidably received in the groove of said rear portion of said holding member, said pushing plate being so sized as to pass through said rear opening;

a hydraulically operated cylinder having a working stem; and a structure having one end connected to said pushing plate and the other end connected to said working stem of the cylinder, so that upon energization of said cylinder, said pushing plate is moved between a position wherein a forward end thereof is deeply inserted into said container through said rear opening and another position wherein said forward end is drawn away from said container.

10. A window glass grinding device having a pivotal arm on which a circular grinding stone is rotatably mounted;

a dressing device for dressing said circular grinding stone;

a pivot support for mounting said dressing device to said pivotal arm in a manner to adjust the position of said dressing device relative to said pivotal arm;

said pivot support comprising a base plate secured to said pivotal arm;

a pivoting arm pivotally connected to said base plate and secured to said dressing device; and an angular position adjuster for adjusting the angle defined between said base plate and said pivoting arm;

said angular position adjuster comprising a bolt pivotally connected to a free end of said pivoting arm;

means defining in said base plate an aperture through which said bolt passes; and at least two nuts engaged with said bolt having the apertured portion of said base plate put therebetween;

said dressing device comprising a container in which dressing members are contained and piled;

a grooved holding member on which said container is mounted, said holding member including a front portion projected forwardly from a front all of said container and a rear portion projected rearwardly from a rear wall of said container;

means defining in said front and rear walls of said container front and rear openings whose lower peripheries are bounded by a bottom wall of the groove of said grooved holding member, said front opening being so sized as to pass therethrough each of said dressing members;

a pushing plate slidably received in the groove of said rear portion of said holding member, said pushing plate being so sized as to pass through said rear opening; and means for reciprocatively moving said pushing plate along said groove between a position wherein a forward end of said pushing plate is deeply inserted into said container through said rear opening and another position wherein said forward end is drawn away from said container.

* * * * *